United States Patent [19]

Levy

[11] Patent Number: 4,884,507

[45] Date of Patent: Dec. 5, 1989

[54] SECURITY CONTAINER

[76] Inventor: Isy R. Levy, 1015 33rd St., NW., Apt. #406, Washington, D.C. 20007

[21] Appl. No.: 273,608

[22] Filed: Nov. 21, 1988

[51] Int. Cl.[4] ..... F42C 19/00; A45C 13/18

[52] U.S. Cl. ..... 102/293; 190/101

[58] Field of Search ..... 42/1.13; 102/293; 190/101, 120

[56] References Cited

U.S. PATENT DOCUMENTS

| | | | |
|---|---|---|---|
| 2,763,209 | 9/1956 | Winer | 102/8 |
| 3,703,780 | 11/1972 | King | 42/1.13 |
| 3,882,323 | 5/1975 | Smolker | 102/202.5 |
| 3,882,324 | 5/1975 | Smolker et al. | 102/202.5 |
| 4,155,079 | 5/1979 | Chiu et al. | 190/101 |
| 4,591,835 | 5/1986 | Sharp | 340/574 |

FOREIGN PATENT DOCUMENTS

| | | | |
|---|---|---|---|
| 88/01003 | 2/1988 | World Int. Prop. O. | 190/101 |

*Primary Examiner*—Charles T. Jordan
*Attorney, Agent, or Firm*—Richard C. Litman

[57] ABSTRACT

A security container, or case for the storage of valuable materials such as documents, credit cards, etc. which are to be destroyed if the case is stolen and including a hingedly interconnected lid and base defining an interior together with a lock which may be key operated or of the combination type, the walls of the lid and base having a continuous conductor thereon which is connected in a circuit to a source of electric power such as a battery and to an explosive, an incendiary device or a dye within the case interior by means of which the stored material may be ruined, the continuous conductor forming part of the circuit for actuating the explosive, the incendiary device or the dye to ruin the stored material when broken such as by cutting the case walls, the conductor also including a normally open switch which is closed when the lock is engaged so that opening the lock by breaking, use of the wrong key, picking, by attempting to set the combination by trial and error or the like similarly moves the switch to the open position, breaking the conductor circuit to actuate the explosive, incendiary or dye device.

16 Claims, 2 Drawing Sheets

SECURITY CONTAINER

FIELD OF THE INVENTION

This invention relates to a security container and, more particularly, to a container for destroying valuable materials such as sensitive documents, credit cards or the like if the container is lost or stolen.

BACKGROUND OF THE INVENTION

With crime including international crime constantly on the rise today, protection of valuable materials such as documents, credit cards, intelligence files, assumes increasing importance particularly when such materials are carried by intelligence personnel and even by a typical individual who frequently will suffer a considerable financial burden if credit cards or the like are stolen. It is quite common for thieves to utilize such credit cards for unauthorized purchases, even to the extent ot using the credit card numbers in a fraudulent manner. Of course, military and governmental intelligence files are frequently the target of enemy agents who use such material to their own advantage. It is not uncommon to carry valuable documents in a suitable container such as a briefcase which is locked,but this is only a minor deterrent to a thief who can easily break into the container by breaking the lock or cutting through the walls of the container to gain access to the materials stored therein.

DESCRIPTION OF THE RELATED ART

Various arrangements have been proposed as a deterrent to such thefts, which include such measures as providing an audible alarm on the carrying case which when appropriated by a thief is energized to signal the theft. Other measures include features such as smoke bombs, dyes, etc. which are released either when the theft occurs or shortly thereafter. It has even been proposed, as described in U.S. Pat. No. 2,763,209 to Winer wherein an incendiary/explosive grenade type device may be dropped by a messenger into a pouch containing the valuable materials prior to a theft, thereby destroying the pouch contents. In U.S. Pat. No. 3,882,324 to Smolker et al. and U.S. Pat. No. 3,882,323 to Smolker, microelectronic circuitry containing sensitive information is adapted to sefl-destruct by a signal or command initiated at one or more remote locations, thereby protecting the classified or sensitive information contained in the circuitry from compromise. In U.S. Pat. No. 4,591,835 to Sharpe a security container is provided with a smoke-emitting device and an audio alarm together with a receiver which, upon receiving a transmited signal from a remote location are activated, thereby signaling that the security container has fallen into the wrong hands.

While such prior art security devices for containers have performed with some degree of satisfaction, a well-trained and skilled thief has a wide variety of tools at his disposal together with knowledge of these various security devices so that entry into such security containers is accomplished with relative ease. Such entry can be accomplished by a skilled theif by picking the container lock, cutting into the container walls or otherwise neutralizing these various alarm devices, thereby gaining access to the material in the container in a surreptitious manner. It is a foregone conclusion that it is far better to destroy, or render useless, sensitve or classified material which can usually be easily replaced rather than permit such material to be used by the thief. Furthermore, in the prior art such as in the aforementioned Smolker or Winer patents, not only are the container contents destroyed but the entire container, particularly in the case of Winer, would be destroyed, thereby producing the likelihood of injury to the thief or even an unsuspecting person into whose hands such a container might have fallen, with attendant liability.

SUMMARY OF THE INVENTION

Accordingly, a primary object of the invention is to provide a new and novel security container for protecting sensitive or valuable material from unauthorized use.

Another object of the invention is to provide a new and novel security container for valuable material such as classified documents, credit cards and the like which are destroyed upon unauthorized opening or breaking into the container.

A further object of the invention is to provide a new and novel security container for valuable materials which may be destroyed or ruined upon any effort to break into the container, whether by cutting into the container body or by breaking the lock on the container, or by the use of a wrong key or by picking the lock.

A still further object of the invention is to provide a new and novel security container for valuable documents in which the documents are destroyed or ruined upon unauthorized entry into container without any external damage to the container that is likely to cause personal injury.

Still another object of the invention is to provide a new and novel security container which is adapted to be provided with either a key-operated lock or a combination lock which responds to unauthorized opening so as to ruin valuables stored within the container.

A further object of the invention is to provide a new and novel combination lock for a container that responds to trial-and-error efforts to set the correct combination.

The objects of the invention and other related objects are accomplished by the provision of a container having a lid and base hingedly interconnected for movement between an open and closed position and defining an interior for the storage of valuables such as documents, credit cards or the like. Means are provided within the interior of the container body for ruining the valuables when the container is broken into such as an explosive device, a dye, an incendiary device or the like and a lock is provided on the body for locking the lid and base together in the closed position. A continuous conductor is disposed on the walls of the lid and base which is connected to a source of electric power such as a battery and which is part of normally inoperative circuit means connected to such an explosive or incendiary device for actuating such a device to ruin the contents of the container. The circuit means are operatively conditioned in response to a break in the conductor for electrically actuating one or more of such devices such as caused by forced entry into the container through one of the walls or by breaking or otherwise unauthorized opening of the lock, the action of the ruiing means being confined to the interior of the container preferably by means of a barrier such as a fireproof liner within the container. The circuit means is also operatively conditioned when attempts are made to set the correct combination on a combination lock by trial and error.

With these and other objects in view which will more readily appear as the nature of the invention is better understood, the present invention resides in the novel construction, combination and assembly hereinafter more fully illustrated, described and claimed, with reference being made to the accompanying drawings wherein the same reference characters are applied to the same or corresponding parts in the various illustrations.

DESCRIPTION OF THE PREFERRED EMBODIMENT

Figure 1:
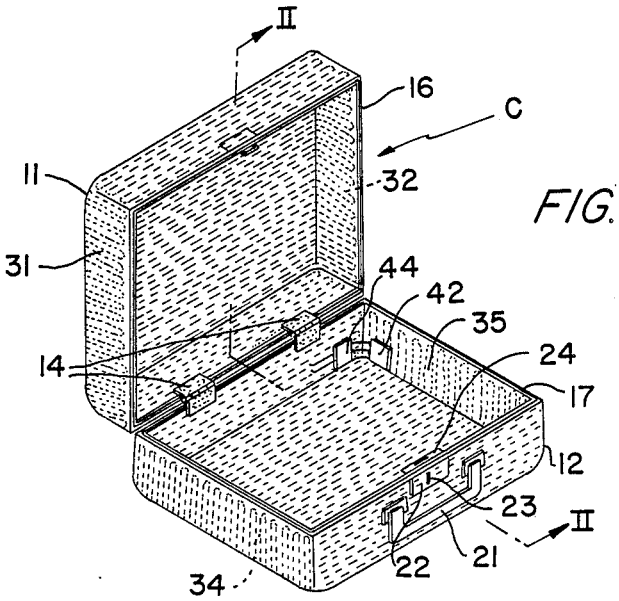
FIG. 1 is a perspective view of a security container constructed in accordance with the invention.

Referring now to FIG. 1, there is shown a security container constructed in accordance with the invention and designated generally by the letter C. In the security container C of FIG. 1, a briefcase type of container is shown but it should be understood that any other suitable container may be used such as an envelope, purse, wallet, etc. The container or case C includes a lid 11 and a base 12 defining an interior 13 which are hingedly interconnected by means such as hinges 14 for pivotal movement between the open position of FIG. 1 and a closed position. The lid 11 and base 12 are provided withan outer edge 16, 17 respectively which are disposed in abutting engagement, as is well-known, in the closed position of the container C. In the illustrated embodiment, preferably the edges 16, 17 are provided with a sealing member 18, 19, respectively so that in the closed position of the container C, a watertight structure is obtained thereby preventing the entry of water into the container interior 13. Preferably, the walls of the container C are provided with a barrier liner 20 which may be of a fireproof material, thereby confining any destructive action on the materials to the interior 13 of the container C.

In the preferred embodiment the container C is provided with a carrying handle 21 on the base 12 and lock means such as a key-operated lock designated generally by the reference numeral 22 having interengaging components **22*a*, 22*b* mounted on the lid 11 and base 12 respectively. As can be seen, lock portion 22*b* includes a keyhole 23 and a keeper 24 for engagement with a lug 26 on the lock component 22*a*. It should be understood that although a key-operated lock is shown in the embodiment of FIG. 1**, a combination lock of any well-known construction may be substituted therefor as will be described hereinafter.

Figure 2:
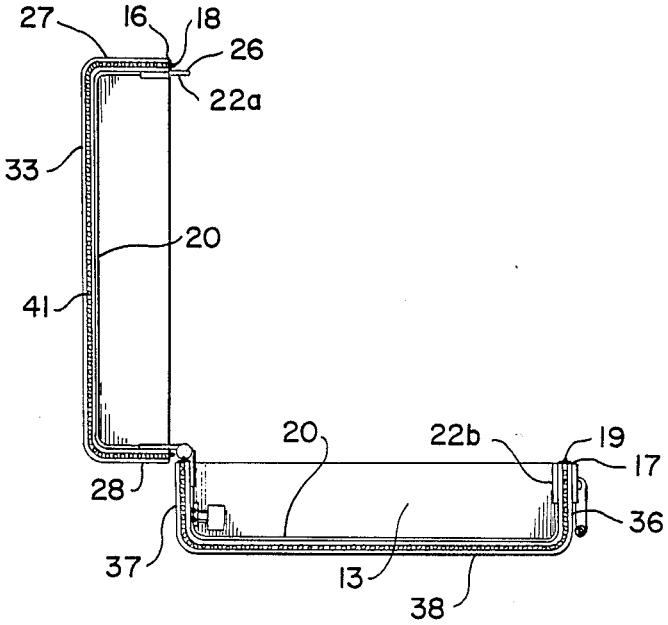
FIG. 2 is a sectional view taken substantially along line 2—2 of FIG. 1.

The container C includes normally-inoperative circuit means including a continuous conductor in the walls of the lid 11 and base 12 which are connected to a source of power also provided in the body. More specifically, the upper and lower walls 27, 28, the sidewalls 31, 32 and the bottom wall 33 of the lid 11 as well as the sidewalls 34, 35, the upper and lower walls 36, 37 and the bottom wall 38 of the base 12 have disposed thereon a continuous conductor 41. Although the conductor 41 is shown in FIGS. 1, 2 as embedded in these walls, it is within the scope of the invention to position the conductor 41 in overlying relationship with the inner surface of these walls.

Disposed within the interior 13 of the container C are means 42 for ruining or destroying the usefulness of the material stored within the container interior 13. In the illustrated embodiment, the ruining means 42 may be an incendiary material 43 enclosed within a housing 44 within which is positioned an igniter such as a filament 46 connected by means of conductors 47, 48 within current-producing means shown in broken lines in FIG. 3 and designated generally by the letter T. It should be understood that the incediary mixture 43 shown in FIG. 4 may be of any well-known type such as thermite which is a mixture of aluminum powder and iron oxide. Also the ruining means 42 may be an explosive mixture such as black powder or a dye in a suitable container which is of a type suitable for ruining or destroying the documents, credit cards, etc. contained within the container interior 13. The dye may of any well-known composition which is capable of obliterating any documentary material, dissolving the plastic or credit cards, etc. For instance, the dye may be an Azo dye which is mioxed with a plasticizer and a solvent such as acetone, methyl ethyl ketone or the like. The current-producing means T is preferably mounted suitably within the container interior 13 as shown in FIG. 1. Furthermore, any combination of an incendiary, explosive or dye may be used.

It should be understood that as a result of the barrier layer 20, the action of the incendiary, explosive and dye or any combination thereof is confined to the container interior 13 thereby precluding any effect externally of the container C to preclude any personal injury.

Figure 3:
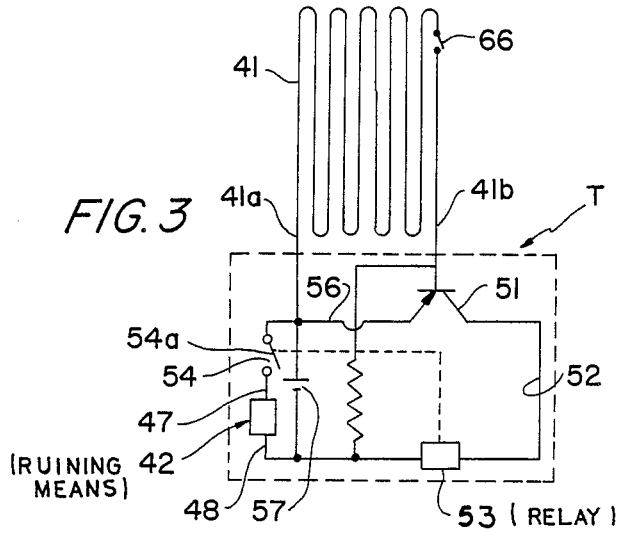
FIG. 3 is a schematic diagram of the circuit incorporated in the container of FIG. 1.
Figure 4:
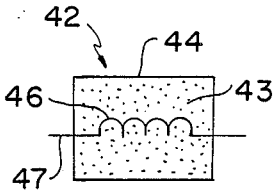
FIG. 4 is a diagrammatic view of a portion of the circuit of FIG. 3.

Referring now to FIG. 3, there is shown the continuous conductor 41 with opposite ends **41*a*, 41*b* connected to the current-producing means T disposed in the housing 44 as shown in FIG. 1. The current-producing means T includes a PNP transistor 51, the collector of which is connected by means of conductor 52 to one side of a relay 53 operatively associated with a normally open switch 54 having a contact 54*a*. The switch 54 is connected on one side by means of the conductor 47 to the ruining means 42 and at the other side by means of the conductor 56 to the emitter of the transistor 51 and to the end 41*a* of conductor 41. The current-producing means T also includes a source of electric power such as a battery 57 connected on one side to conductor 56 andon the other side to conductor 48 connected in turn to the other side of relay 53**.

As can be seen in the circuit of FIG. 3, the relay 53 is operatively associated with the switch 54 which opens and closes in accordance with the state of excitation of the relay. In addition, a high resistance 61 is connected between conductor 48 and the other end **41*b* of conductor 41 as well as to the base of transistor 51**.

In the operation of the circuit of FIG. 3, the switch 54 is normally open as shown. In the illustrated condition of the circuit of FIG. 3 with the conductor 41 extending continuously throughout the body of the container C, the current from the battery 57 flows through the resistor 61 to the base of transistor 51, cutting off the collector current in the transistor. When the conductor 41 is broken, such as might occur by an unauthorized entry into the body of the container C by tearing or cutting the container wall, the conductor 41 is short-circuited and the current flows into the emitter of transistor 51 firing the transistor so that current flows through the relay 53, energizing the relay coil and closing the switch 54 whereby a current pulse is applied to the igniter 46 of the ruining means 42 igniting the combustible mixture, detonating the explosive mixture or discharging the dye so that the material stored in the container is ruined so as to be useless. As a result of the barrier liner 20, all such actions by the ruining means are confined to the container interior 13 precluding destruction of the exterior of the container and possible injury to persons in the area.

Figure 5:
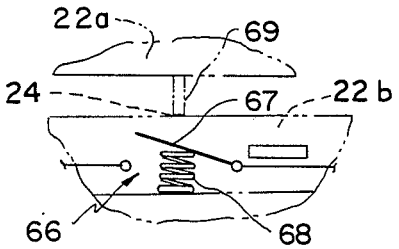
FIG. 5 is a diagrammatic view of a portion of the lock incorporated in the container of FIG. 1.
Figure 6:
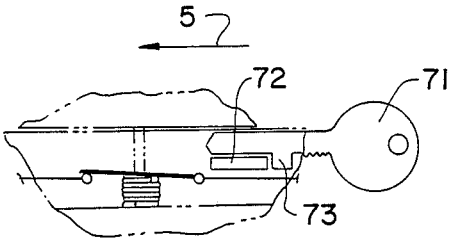
FIG. 6 is a view similar to FIG. 5 showing a key associated with the lock of FIG. 5.

It can be understood that, frequently, unauthorized entry into the container C may be obtained by a breaking or picking of the lock 22. To obviate this event, means are provided for interrupting the conductor 41 upon the forcing open of the lock 22 such as by breaking, picking or the like. More specifically, normally open switch means 66 are provided in the continuous conductor 41 in operative association with the lock 22 as shown best in FIGS. 5–7. As shown in FIG. 5, the switch means 66 includes a pivotally mounted contact 67 preferably within the body of the lock connected serially with the conductor 41 and urged into the open position by means such as a spring 68. The lock component 22a on th elid 11 includes a tang 69 which is received in the slotted portion 24 of the lock component 22*b* and at the same time engages the contact 67 to move the contact into the closed position as shown in FIG. 6. Thus, when the container C is closed and locked, continuity of the conductor 41 is preserved. Separation of the lock portions 22*a*, 22*b* such as might be accomplished by a thief, therefore moves the tang 69 out of engagement with the contact 67, interrupting the continuous conductor 41 actuating the ruining means as explained above.

Figure 7:
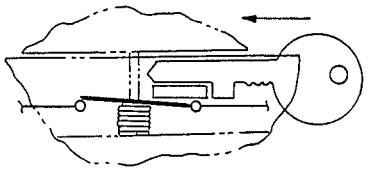
FIG. 7 is a view similar to FIG. 6 showing the key in an operative position within the lock.

The lock arrangement of FIGS. 5 through 7 includes latch means actuated by the insertion of the proper associated key 71 into the lock keyhole 23. The latch means includes a sliding latch 72 suitably arranged for sliding movement in the direction of key insertion as indicated by the arrow 5 into overlying retaining engagement with the contact 67, remaining therein while the key 71 is rotated, so that the lock may be opened with the proper key while the contact 67 is maintained in the closed position as shown in FIG. 7, thereby maintaining the continuity of the conductor 41. It will be noted that the key 71 is provided with a lug 73 which engages the sliding latch 72 during the insertion of the key into the keyhole in the direction of the arrow S, and the latch 72 is preferably spring-loaded so as to return to the position of FIG. 6 when the key is removed.

Figure 8:
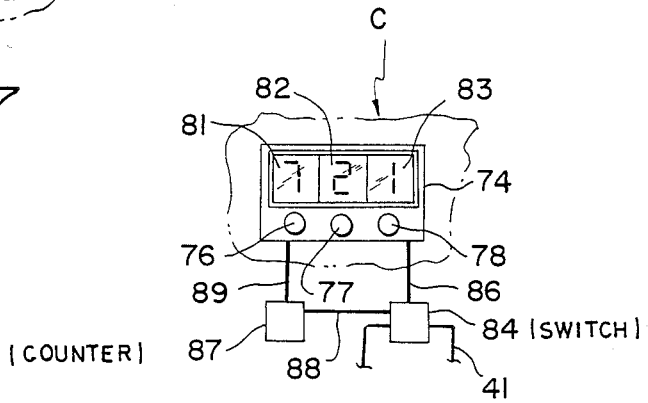
FIG. 8 is a fragmentary view of a portion of a modification of the container of FIG. 1.

Referring now to FIG. 8, there is shown a modification of the container of FIG. 1 wherein like numerals are used to identify like parts. The modified security container of FIG. 8 is identified by the letter C′ and is provided with a combination type lock 74 of any well-known construction as modified in accordance with the invention, all of the other parts of the container C′ being identical to that of the embodiment of FIG. 1.

The combination lock 74 installed on the container base 12 and adapted for cooperation with the lock part on lid 11 is of the electrically actuated type and includes a plurality of pushbuttons 76–78 each of which is associated with a digital display panel 81–83, respectively, each of the seven-segment type. As is well-known, a setting of the proper combination on the display panels 81–83, such as the numbers shown in FIG. 8 using the respective pushbuttons 76–78, permits the lock 74 to be opened. Also, as is well-known, the pushbuttons 76–78 may be manually depressed to sequence the number on each associated display panel between zero and nine.

As the combination lock 74 is electrically actuated, a switch 84 of the type corresponding to the switch 66 of the embodiment of FIG. 1 is provided which may be of the electrically operated type so that when the proper combination is set on the lock 74, an electrical signal is transmitted to the switch 84 by means of conductor 86 to retain the switch 84 in the closed position, preventing actuation of the ruining means incorporated in the container interior 13. However, any attempt to break the combination lock 74 by an unauthorized individual inhibits this signal, permitting the switch 84 to move to the open position, thereby actuating the ruining means 42.

In another approach, the unauthorized person who attempts to locate the proper unlocking the combination for the lock 74 by a simple trial-and-error technique sequencing the range of numbers on the lock may be defeated by a counting of the number of attempts made through the decrementing or incrementing of a counter 87 which, by either counting up or down a predetermined number of attempts (for instance, five attempts), at the end of the last attempt sends out a signal through conductor 88 to the switch 84 to move the switch contact to the open position, again activating the ruining means 42. The signal for decrementing or incrementing the counter 87 is sent, on each attempt to find the correct combination, through conductor 89 from the lock 74 to the counter 87.

It is to be understood that the present invention is not limited to the sole embodiment described above, but encompases any and all embodiments within the scope of the following claims.

What is claimed is:

1. A security container for the storage of valuables such as credit cards or the like comprising, in combination:

a body including a lid and a base adapted for interfitting engagement and having walls defining an interior for the storage of valuables;

means for hingedly interconnecting said lid and base together for pivotal movement between an open and closed position;

lock means on said body for releasably locking said lid and base together in said closed position;

means within said body interior for ruining said valuables;

a source of electric power on said body; and normally inoperative circuit means including a continuous conductor on said lid and base walls connected to said source of power and to said ruining means for actuating said ruining means, means associated with said lock means for interrupting said continuous conductor upon the unauthorized opening of said lock means, said circuit means being responsive to a break in said conductor for operatively conditioning said circuit means to actuate said ruining means thereby ruining said stored valuables.

2. A container in accordance with claim 1 wherein said ruining means comprises incendiary means.

3. A container in accordance with claim 2 wherein said incendiary means comprises:

a combustible mixture in said body interior; and ignition means within said combustible mixture and wherein said circuit means includes means connected to said ignition means for igniting said combustible mixture upon the occurrence of said break in said conductor.

4. A container in accordance with claim 1, wherein said ruining means includes explosive means.

5. A container in accordance with claim 1 wherein said ruining means comprises a dye.

6. A container in accordance with claim 1 including means on said walls for confining said actuated ruining means to said body interior.

7. A container in accordance with claim 6 wherein said confining means includes a layer of fire-resistant material on said body walls.

8. A container in accordance with claim 1 wherein said lid and base are each provided with a continuous outer peripheral edge, said edges adapted for abutting engagement in the closed condition of said container and including waterproofing means associated with said peripheral edges for sealing said container in the closed condition.

9. A container in accordance with claim 1 wherein said continuous conductor is disposed within said walls of said lid and base.

10. A container in accordance with claim 1 wherein said continuous conductor is disposed in overlying relationship with the inner surface of said walls of said lid and base.

11. A container in accordance with claim 1 wherein said means for interrupting said continuous conductor include a normally open switch in said conductor operatively associated with said lock means, said lock means including means for releasably retaining said switch in a closed position to maintain the continuity of said continuous conductor, said retaining means being responsive to the opening of said lock means to release said switch for interrupting the continuity of said conductor and for actuating said ruining means.

12. A container in accordance with claim 1 wherein said lock means comprises:

a key-operated lock;

switch latching means movable between a switch-releasing position and a switch-retaining position in said lock means; and a key having a tang associated with said lock for opening said lock, said key tang being adapted to move said switch latching means into latching engagement with said switch to maintain said switch in the closed position during the unlocking of said lock with said key.

13. A container in accordance with claim 1 wherein said lock means comprises a combination lock and wherein said means for interrupting said continuous conductor include a normally open switch in said conductor operatively associated with said combination lock and including means for retaining said normally open switch in the closed position upon the setting of the correct combination on said combination lock for opening said container.

14. A container in accordance with claim 13 including means responsive to a plurality of incorrect settings of the combination on said lock for moving said normally open switch into the open position.

15. A container in accordance with claim 14 wherein said means responsive to said plurality of incorrect settings comprises a counter.

16. A container in accordance with claim 15 wherein said combination lock comprises a plurality of pushbuttons, a digital display panel associated with a respective one of said pushbuttons for indicating a selected number of a combination for said lock whereby a selected number on said display panels is obtained by the operation of a corresponding pushbutton.

* * * * *